US007478686B2

(12) United States Patent
Richard et al.

(10) Patent No.: US 7,478,686 B2
(45) Date of Patent: Jan. 20, 2009

(54) ONE TRIP WELL DRILLING TO TOTAL DEPTH

(75) Inventors: Bennett M. Richard, Kingwood, TX (US); Alan Brent Emerson, Cypress, TX (US); Mathew J. Jabs, Houston, TX (US); Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 188 days.

(21) Appl. No.: 11/153,156

(22) Filed: Jun. 15, 2005

(65) Prior Publication Data

US 2006/0016623 A1 Jan. 26, 2006

Related U.S. Application Data

(60) Provisional application No. 60/580,576, filed on Jun. 17, 2004.

(51) Int. Cl.
*E21B 7/20* (2006.01)

(52) U.S. Cl. ..... 175/57; 175/230

(58) Field of Classification Search ..... 175/57, 175/230, 171; 166/207, 277
See application file for complete search history.

(56) References Cited

U.S. PATENT DOCUMENTS

| | | | | |
|---|---|---|---|---|
| 3,420,363 | A | 1/1969 | Blickensderfer | |
| 4,990,545 | A | 2/1991 | Hourai et al. | |
| 5,040,283 | A * | 8/1991 | Pelgrom | 29/447 |
| 5,049,591 | A | 9/1991 | Hayashi et al. | |
| 5,145,935 | A | 9/1992 | Hayashi | |
| 6,543,552 | B1 * | 4/2003 | Metcalfe et al. | 175/57 |
| 6,583,194 | B2 | 6/2003 | Sendijarevic | |
| 6,752,208 | B1 * | 6/2004 | Nguyen | 166/280.1 |
| 6,817,441 | B2 | 11/2004 | Murakami et al. | |
| 6,854,522 | B2 * | 2/2005 | Brezinski et al. | 166/387 |
| 7,066,259 | B2 * | 6/2006 | Duggan et al. | 166/277 |
| 7,104,317 | B2 * | 9/2006 | Richard et al. | 166/207 |
| 7,159,673 | B2 * | 1/2007 | Van Dijk | 175/51 |
| 7,185,709 | B2 * | 3/2007 | Schetky et al. | 166/380 |
| 2004/0055758 | A1 * | 3/2004 | Brezinski et al | 166/384 |
| 2005/0171248 | A1 | 8/2005 | Li et al. | |

FOREIGN PATENT DOCUMENTS

WO 02088510 A1 11/2002

OTHER PUBLICATIONS

Composite Technology Development, Inc., Engineered Material Solutions, http://www.ctd-materials.com/products/emc.htm, 2001, 1-4.

* cited by examiner

*Primary Examiner*—Giovanna C Wright
(74) *Attorney, Agent, or Firm*—Steve Rosenblatt

(57) ABSTRACT

Drilling a well to total depth without tripping the bit out of the hole despite encountering a troublesome zone is made possible by using a memory based composite material delivered with the drill pipe or advanced over it, as needed. The material can be activated as a troublesome zone is encountered and assumes as former configuration that places it in sealing relation to the troublesome zone in the bore hole while spacing it from the drill pipe so as to allow resumption of drilling with the troublesome zone isolated.

21 Claims, 2 Drawing Sheets

ONE TRIP WELL DRILLING TO TOTAL DEPTH

PRIORITY INFORMATION

This application claims the benefit of U.S. Provisional Application No. 60/580,576, filed on Jun. 17, 2004.

FIELD OF THE INVENTION

The field of this invention relates to drilling a wellbore and more particularly a monobore in a single trip before installing a casing or liner.

BACKGROUND OF THE INVENTION

The traditional way to drill a well involves starting with a large bore and drilling ever decreasing bores below so that a new section of casing can fit through the casing already run and cemented. In this technique, as each segment is drilled there is what is called flat time or time when no drilling is going on. Instead, time, which costs the operator money, is taken up tripping the drill bit out of the hole and running in each size of casing.

One more recent alternative to this well used technique is a monobore completion. In this type of well drilling a single size hole is drilled from the surface to total depth. Even with this technique, unless the productive interval is relatively shallow, any time a problem zone is breached in the drilling, the drilling has to stop and the bit pulled out of the hole so that casing or liner can be run to isolate the problem zone so that drilling can resume. This technique is necessary because the mud weight is the sole means of well control during this type of drilling and the problem zone needs to be isolated with cemented casing or liner before drilling can resume safely.

Another known technique is to drill with a downhole motor powered by flow from coiled tubing going through a lubricator for well control. Although a bore can be continuously drilled this way, it is limited to rather small bore sizes.

Accordingly for the larger bores, even the monobore technique does not reduce the flat time from tripping in and out of the bore as each section of casing or liner is run in after a segment of the monobore is drilled.

What is needed is a technique that allows the ability to deal with problem zones of any type while drilling so as to isolate them without having to pull the bit out of the hole. This problem is addressed for applications where drilling with a downhole motor and coiled tubing through a lubricator will not produce the required bore diameter. The technique involves being able to isolate the zone with the drill string and bit still in the hole in a manner that allows drilling to resume as the zone is isolated. In part the solution involves the use of composite memory materials to be delivered with the drill string or subsequently over it when the troublesome zone is encountered. Local application of energy or heat activates the material to another shape to seal the troublesome zone and, if previously attached to the drill pipe, to release from it to allow drilling to resume. This general description will be more readily understood by those skilled in the art from a review of the description of the preferred embodiment and the claims, both of which appear below.

SUMMARY OF THE INVENTION

Drilling a well to total depth without tripping the bit out of the hole despite encountering a troublesome zone is made possible by using a memory based composite material delivered with the drill pipe or advanced over it, as needed. The material can be activated as a troublesome zone is encountered and assumes as former configuration that places it in sealing relation to the troublesome zone in the bore hole while spacing it from the drill pipe so as to allow resumption of drilling with the troublesome zone isolated.

DETAILED DESCRIPTION OF THE DRAWINGS

DETAILED DESCRIPTION OF THE PREFERRED EMBODIMENT

Figure 1:
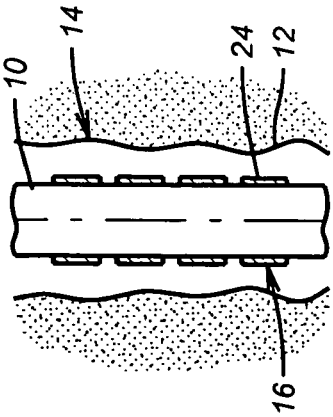
FIG. 1 is a run in view of the preferred embodiment showing the composite sleeves in position.

FIG. 1 shows a drill string 10 just reaching a problem zone 12 in a wellbore 14. The drill bit is at the lower end of the drill string and is omitted from FIGS. 1-4. Those skilled in the art will appreciate that the drill bit can be coupled with an underreamer to expand the drilled hole produced by the bit, in a known manner. Mounted to the drill string 10 to one or more stands of pipe are a sleeve 16. This sleeve is made from an elastic memory composite material and is commercially available from Composite Technology Development Inc of Lafayette, Colo. This company describes this product and its current attributes and applications as follows:

> Elastic Memory Composite (EMC) materials are based on thermoset shape memory polymers, which enable the practical use of the shape memory properties in fiber-reinforced composites and other specialty materials. The applications for these revolutionary new materials are broad ranging, including mission-enabling components for spacecraft, performance enhancing and cost saving industrial and medical applications, deployable equipment for emergency and disaster relief, and improvements in the performance of sports equipment.

EMC materials are similar to traditional fiber-reinforced composites except for the use of an elastic memory thermoset resin-matrix. The elastic memory matrix is a fully cured polymer, which can be combined with a wide variety of fiber and particulate reinforcements and fillers. The unique properties of the matrix enable EMC materials to achieve high packaging strains without damage. Strains are induced by elevating the temperature of the EMC material and then applying a mechanical force. The shape memory characteristics enable the high packaging strains to be "frozen" into the EMC by cooling. Deployment (i.e., shape recovery) is effected by elevating the temperature. The temperature at which these operations occur is adjustable.

At lower temperatures, the performance of EMC materials follows classical composite laminate theory. At higher temperatures, EMCs exhibit dramatically reduced stiffnesses due to significant matrix softening of the resin. Adequately addressing the mechanics of the "soft-resin" will enable the EMC materials to provide repeatable stowage and deployment performance without damage and or performance changes. Products fabricated from these materials can be deformed and reformed repeatedly. Products utilizing EMC materials can be fabricated with conventional composite fabrication processes and tooling. EMC Materials:

- Can be formulated with low cost components
- Use standard existing polymer and composite manufacturing processes
- Regain original shape with applied heat, no other external force is required
- Possess widely adjustable deformation and reformation temperatures are
- Are suitable for repeated deformation and reformation cycles
- Reform accurately to original shape
- Maintain high strain capability when heated
- Enable large volume reduction for packing
- Issues such as shelf life, chemical reaction, toxicity, explosion hazard, or environmental impact are not of concern Polymers have a characteristic temperature, called the glass transition temperature (Tg), at which the polymer softens. CTD's elastic memory polymer becomes both soft and highly ductile above this transition temperature. Below this temperature the polymer is hard and rigid, or glassy. Above TG the elastic memory polymer can be highly deformed and stretched into a different shape, such as folded into a compact shape. When held in this shape and cooled, it retains the new shape indefinitely. When reheated above TG, the material reforms to its original shape without external force, and regains its original properties once cooled. Thus an EMC tubular structure could be heated, collapsed and stowed, and then later reformed simply by heating.

EMC materials are ideally suited for deployable components and structures because they possess high strain-to-failure ratios, high specific modulus, and low density. By contrast, most traditional materials used for deployable structures have only two of these three attributes.

Initial EMC development efforts have targeted space applications. Tremendous support for the development of CTD's EMC materials has been received from NASA, the Air Force, BMDO and other Government agencies, and the aerospace industry. EMC materials have the potential to enable a new generation of space deployable components and structures, which would eliminate nearly all the limitations and shortfalls of current spacecraft deployable technologies.

Figure 2:
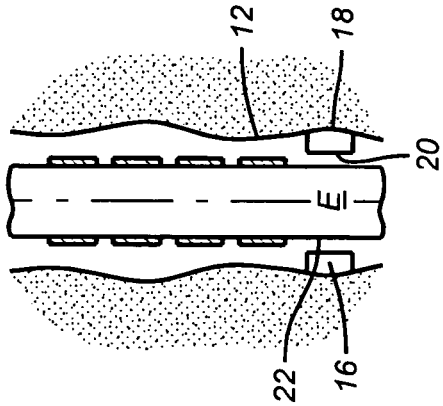
FIG. 2 shows one sleeve activated to seal against a troublesome zone and clear of the drill string.

With that as a background on the preferred material for the sleeve 16 those skilled in the art will appreciate that the original dimensions for fabrication of sleeve 16 will approximate its desired final dimensions in the wellbore after activation, as shown in FIG. 2. The outer dimension 18 needs to be large enough after activation, to sit firmly against the troublesome zone 12 in a way that one or more than one sleeve 16 can isolate the zone upon deployment. Rubber end rings could be used to enhance the sealing ability. At the same time, the inner dimension 20 should clear the outside wall 22 of the drill string 10 so that the drill string 10 can be rotated with minimal and preferably no contact to the sleeve or sleeves 16. After initial forming to these general dimensional specifications, the sleeve 16 can be raised above the glass transition temperature while mounted over a stand of drill pipe so that while in the fluid form its shape can be reconstituted to fit snugly or even loosely over the stand of drill pipe 10. The reformed exterior dimension 24, shown in FIG. 1 should preferably be smaller than the bore being drilled either by the bit or by an associated under-reamer. In that way the sleeve 16 will not be damaged by advancement of the bit and will preferably have minimal contact with the borehole wall during drilling. Loosely fitting the sleeve 16 to a stand of drill pipe 10 allows for some relative rotation between them should the sleeve 16 make contact with the borehole 14 during drilling.

Figure 4:
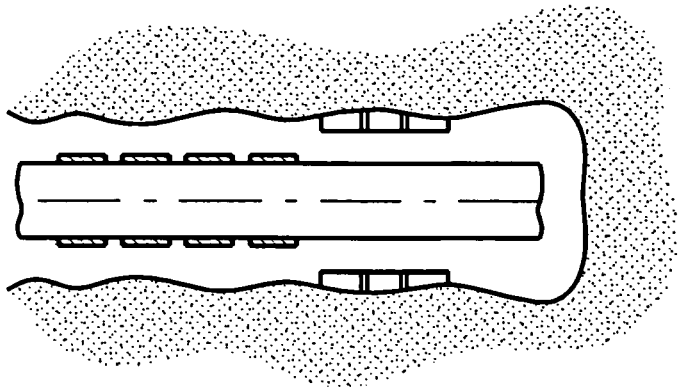
FIG. 4 shows another sleeve in position against the troublesome zone.
Figure 3:
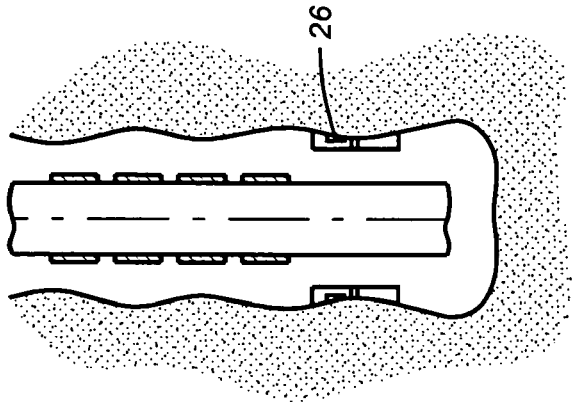
FIG. 3 shows an additional sleeve in position against the zone.

Additionally, the activation temperature of the sleeves 16 can be adjusted to be higher than the anticipated well fluid temperature to avoid deployment without introduction of an energy source, schematically labeled E in FIG. 2 to cause transition back to the original shape. FIG. 3 illustrates that two sleeves 16 can be placed next to each other, or three or more as illustrated in FIG. 4. Sealing material can also be incorporated into one or more sleeves 16 so that when it is activated the sealing is enhanced by the presence of the sealing material, shown schematically as 26 in FIG. 3.

Figure 5:
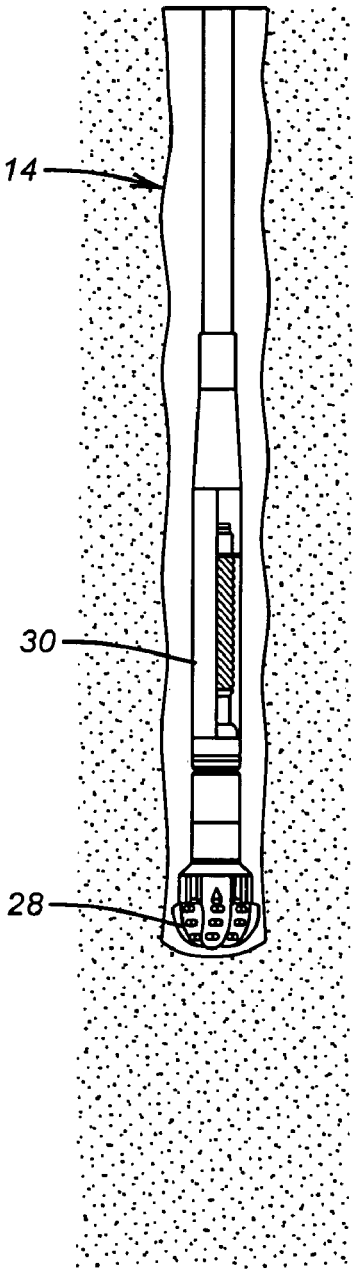
FIG. 5 is an alternate embodiment in the run in position during drilling.
Figure 6:
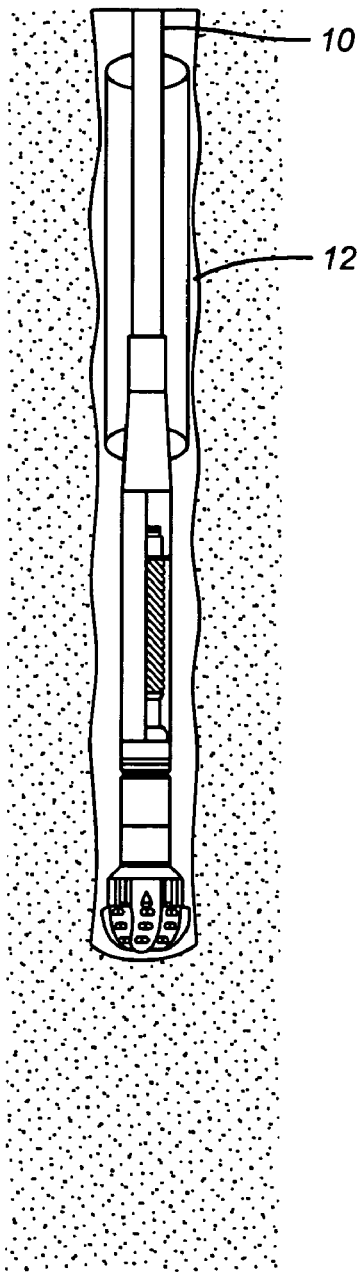
FIG. 6 shows the drilling reaching a troublesome zone and a sleeve being delivered from above to near the bottom hole assembly.
Figure 7:
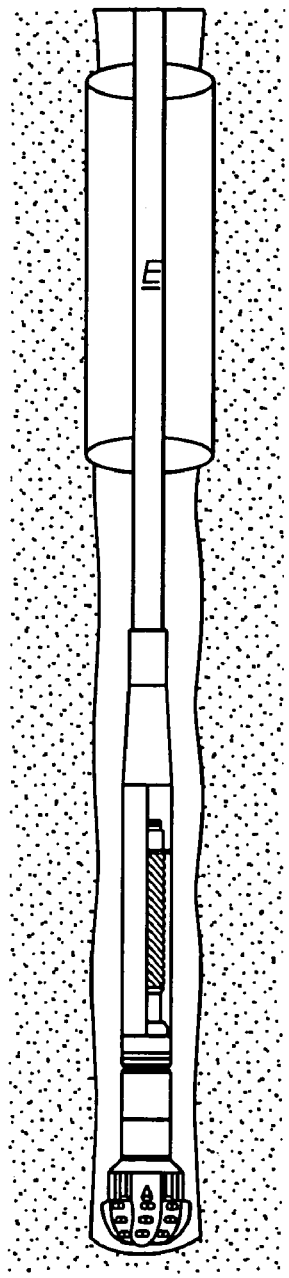
FIG. 7 shows the sleeve actuated against the troublesome zone and away from the drill string to allow drilling to continue.

FIGS. 5-7 illustrate drilling the borehole 14 with a bit 28 and an under-reamer 30 located above it. The sleeves 16 are not in position during drilling. However, when a problem zone 12 is encountered the sleeve or sleeves 16 can be lowered over the drill pipe 10 or expanded from drill pipe 10 as shown in FIG. 6. An energy source E is delivered through the drill pipe to the vicinity of the sleeve 16 and it resumes its original shape taking its outer wall against the borehole 14 and its inner wall away from the drill string 10, as shown in FIG. 7. In this variation of the technique, the sleeve or sleeves 16 can be allowed to travel to near the bottom hole assembly by gravity or with reverse circulation outside the drill string 10 or by use of a direct or indirect force from outside or inside the drill string 10. Thus whether the sleeve or sleeves are delivered with the drill pipe or inserted in the wellbore 14 after the troublesome zone is encountered, the desired result on activation is the same, isolation with an ability to continue drilling.

It should be noted that more than one troublesome zone 12 can be isolated in the techniques described above. The troublesome zones can be close together or thousands of feet apart. If the sleeves closest to the bottom hole assembly have already been activated to isolate a higher troublesome zone 12, remaining sleeves on the drill string 10 can be used to isolate another zone further down the bore. If the sleeves 16 are secured to the drill pipe one above the other, it will mean that to isolate a lower zone after an upper zone has been isolated, the drilling will need to continue to position the remaining sleeves opposite the new lowers zone because the lowermost sleeves have been deployed above. The inside dimension of the deployed sleeve or sleeves need to be large enough to allow the remaining undeployed sleeves to pass, as drilling continues. Similarly, if the additional sleeves are to be subsequently delivered from the surface after one zone has already been isolated, then those new sleeves must clear through the previously deployed sleeves as the new sleeves travel down the drill pipe 10. Alternatively, to the extent space is available, the sleeves can be nested near the bottom hole assembly and constructed to activate at different temperatures with the outermost sleeve activated at the lowest temperature. If done in that manner, several sleeves can be run in with the drill string 10 and while positioned close to the bottom hole assembly. When done this way, there is no need to drill further into a subsequent troublesome zone after an earlier deployment in a higher troublesome zone, as the next available sleeve 16 would already be in close proximity to the bottom hole assembly.

Although elastic memory composite materials are preferred, the invention encompasses a technique that allows isolation of troublesome zones without having to pull out of the hole, thereby allowing drilling to progress until total depth is reached. Other materials and techniques that make drilling to depth without pulling out of the hole while having the ability to isolate one or more troublesome zones is within the scope of the invention.

While the preferred embodiment has been set forth above, those skilled in art will appreciate that the scope of the invention is significantly broader and as outlined in the claims which appear below.

We claim:

1. A method for drilling to total depth, through a formation that requires isolation, without having to pull the bit from the well and without using a surface lubricator, comprising:

encountering a formation that requires isolation while drilling the well;

isolating said formation with a shape memory polymer without an exterior layer of another material that contacts the formation without removal of the drill pipe from the well; and providing clearance around said drill pipe, while it rotates, from said shape memory polymer after said isolating.

2. The method of claim 1, comprising:

initially mounting at least one isolation device on the drill pipe.

3. The method of claim 2, comprising:

using a material that changes shape for said formation isolation.

4. The method of claim 3, comprising:

using a material that reverts to a former shape for said formation isolation.

5. The method of claim 4, comprising:

using a temperature stimulus to trigger said reverting to a former shape.

6. The method of claim 5, comprising:

configuring said former shape to contact the wellbore wall to isolate said formation.

7. The method of claim 6, comprising:

configuring said former shape to have an internal dimension that leaves a gap around the drill pipe.

8. The method of claim 7, comprising:

making the gap large enough to allow passage of another object to pass along the drill pipe to another formation below the first isolated formation;

using said another object to isolate a subsequent formation in the wellbore.

9. The method of claim 1, comprising:

using a material that changes shape for said formation isolation.

10. The method of claim 9, comprising:

using a material that reverts to a former shape for said formation isolation.

11. The method of claim 10, comprising:

using a stimulus to trigger said reverting to a former shape.

12. The method of claim 10, comprising:

configuring said former shape to contact the wellbore wall to isolate said formation.

13. The method of claim 12, comprising:

making the gap large enough to allow passage of another object to pass along the drill pipe to another formation below the first isolated formation;

using said another object to isolate a subsequent formation in the wellbore.

14. The method of claim 10, comprising:

mounting a seal on said material.

15. The method of claim 10, comprising:

using an elastic memory thermoset resin matrix for said material.

16. The method of claim 10, comprising:

using an elastic memory composite for said material.

17. A method for drilling to total depth, through a formation that requires isolation, without having to pull the drill pipe from the well and without using a surface lubricator, comprising:

encountering a formation that requires isolation while drilling the well;

isolating said formation with a shape memory polymer without removal of the drill pipe from the well; and providing clearance around said drill pipe, while it rotates, from said shape memory polymer after said isolating;

delivering at least one isolation device over drill pipe when the drill pipe is in the wellbore.

18. A method for drilling to total depth, through a formation that requires isolation, without having to pull the drill pipe from the well and without using a surface lubricator, comprising:

encountering a formation that requires isolation while drilling the well;

isolating said formation without removal of the drill pipe from the well; using for said formation isolation a material that changes shape and with a triggering stimulus reverts to a former shape;

using a plurality of formation isolators on the drill pipe;

providing different trigger temperatures for said formation isolators.

19. The method of claim 18, comprising:

nesting said formation isolators on the drillpipe.

20. A method for drilling to total depth, through a formation that requires isolation, without having to pull the drill pipe from the well and without using a surface lubricator, comprising:

encountering a formation that requires isolation while drilling the well;

isolating said formation without removal of the drill pipe from the well; using for said formation isolation a material that changes shape and with a triggering stimulus reverts to a former shape;

using a plurality of sealing devices on the drill pipe;

providing different stimuli for said sealing devices.

21. A method for drilling to total depth, through a formation that requires isolation, without having to pull the drill pipe from the well and without using a surface lubricator, comprising:

encountering a formation that requires isolation while drilling the well;

delivering at least one isolation device over drill pipe when the drill pipe is already in the wellbore;

isolating said formation with said isolation device without removal of the drill pipe from the well; and providing clearance around said drill pipe to said isolation device, while said drill string rotates after said isolating.

* * * * *